US009752225B2

(12) United States Patent
Morita et al.

(10) Patent No.: US 9,752,225 B2
(45) Date of Patent: Sep. 5, 2017

(54) SURFACE TREATMENT METHOD AND COATING METHOD FOR STEEL MATERIAL, AND METHOD FOR PRODUCING MACHINE COMPONENT

(75) Inventors: Haruji Morita, Hanno (JP); Tsuneo Tate, Tokyo (JP); Akira Shiozawa, Okaya (JP)

(73) Assignees: KOMATSU LTD., Tokyo (JP); COTEC CORPORATION, Tokyo (JP); NIPPON KAZAI Co., Ltd., Nagano (JP)

( * ) Notice: Subject to any disclaimer, the term of this patent is extended or adjusted under 35 U.S.C. 154(b) by 435 days.

(21) Appl. No.: 14/350,724

(22) PCT Filed: Sep. 12, 2012

(86) PCT No.: PCT/JP2012/073363

§ 371 (c)(1),
(2), (4) Date: Apr. 9, 2014

(87) PCT Pub. No.: WO2013/061705

PCT Pub. Date: May 2, 2013

(65) Prior Publication Data

US 2014/0290802 A1 Oct. 2, 2014

(30) Foreign Application Priority Data

Oct. 25, 2011 (JP) ..... 2011-234331

(51) Int. Cl.
*C23C 22/08* (2006.01)
*C23C 22/83* (2006.01)
(Continued)

(52) U.S. Cl.
CPC ..... *C23C 8/42* (2013.01); *C23C 8/80* (2013.01); *C23C 22/08* (2013.01); *C23C 22/47* (2013.01); *C23C 22/83* (2013.01)

(58) Field of Classification Search
CPC .. C23C 8/42; C23C 8/80; C23C 22/08; C23C 22/40; C23C 22/44; C23C 22/47; C23C 22/50; C23C 22/78; C23C 22/82–22/83
See application file for complete search history.

(56) References Cited

U.S. PATENT DOCUMENTS 5,221,370 A 6/1993 Jo et al.
6,027,579 A * 2/2000 Das ..... C23C 22/83 106/14.12

(Continued)

FOREIGN PATENT DOCUMENTS

CN 101698938 A 4/2010
JP 46-15406 4/1971

(Continued)

OTHER PUBLICATIONS

The International Search Report for the corresponding international application No. PCT/JP2012/073363, issued on Dec. 11, 2012.

(Continued)

*Primary Examiner* — Lois Zheng
(74) *Attorney, Agent, or Firm* — Global IP Counselors, LLP

(57) ABSTRACT

This surface treatment method comprises a rustproofing step, a rinsing step, and a cleaning step. In the rustproofing step, a rustproofing liquid containing orthophosphoric acid and an organic acid is used to perform a rustproofing treatment on the surface of a steel material. In the rinsing step, a treatment liquid containing an oxo acid salt of a transition metal is used to perform a rinsing treatment on the surface of the steel material. In the cleaning step, the surface of the steel material that has undergone the rinsing step is subjected to a cleaning treatment.

13 Claims, 7 Drawing Sheets

(51) Int. Cl.

| | |
|---|---|
| ***C23C 8/42*** | (2006.01) |
| ***C23C 22/47*** | (2006.01) |
| ***C23C 8/80*** | (2006.01) |
| *C23C 22/82* | (2006.01) |

(56) References Cited

U.S. PATENT DOCUMENTS

| | | | |
|---|---|---|---|
| 7,879,158 | B2 | 2/2011 | Dietsche et al. |
| 2003/0022007 | A1 | 1/2003 | Ravenscroft et al. |
| 2006/0162820 | A1 | 7/2006 | Dietsche et al. |
| 2011/0305840 | A1 | 12/2011 | Ishii |

FOREIGN PATENT DOCUMENTS

| | | | |
|---|---|---|---|
| JP | 59-47396 | A | 3/1984 |
| JP | 3-20476 | A | 1/1991 |
| JP | 7-62553 | A | 3/1995 |
| JP | 2003-156053 | A | 5/2003 |
| JP | 2005-264073 | A | 9/2005 |
| JP | 2006-520852 | A | 9/2006 |
| JP | 2009-270137 | A | 11/2009 |
| JP | 2010-106334 | A | 5/2010 |
| WO | 03/093533 | A1 | 11/2003 |

OTHER PUBLICATIONS

The Office Action for the corresponding Chinese patent application No. 201280051867.9, issued on May 5, 2015.

The Office Action for the corresponding Japanese application No. 2013-540699, issued on Jun. 21, 2016.

"Chemical Cleaning Technology for Industrial Equipment", Quingzhu Jiao, etc Petroleum Industry Press, published Jun. 30, 1995.

The Office Action for the corresponding Chinese application No. 201280051867.9, issued on May 4, 2016.

* cited by examiner

| No. | Step | Name of liquid | Treatment method | Liquid temp. and dipping time | Notes |
|---|---|---|---|---|---|
| 1 | degreasing | degreasing liquid #5000 (diluted 5 times) | dipping | 40-70°C, 40 min. | |
| 2 | first water washing | fresh water (well water) | dipping | 1-2 min. | |
| 3 | rustproofing | Appre (diluted 10 times) | dipping | 40-50°C, 40 min. | |
| 4 | second water washing | Appre (diluted 100 times) | ultrasonic/ spraying | room temp, 40 min. (ultrasonic, 3 times back and forth) | pipe-shaped object → ultrasonic, flat/rod-shaped → spray |
| 5 | rinsing | T rinse (diluted 10 times) | dipping | room temp., 1-2 min. | |
| 6 | cleaning | fresh water (well water) | dipping | 40-70°C, 3 min. | |
| 7 | spray | pure water | spraying | about 30 sec. | |

FIG. 2

| Solution | Components | Concentration (wt%) |
|---|---|---|
| degreasing liquid #5000 | sodium silicate (water glass) | 20-50 |
| | diphosphoric acid (pyrophosphoric acid) | 0.02-2.00 |
| | special modified ionized water | 50-70 |
| Appre solution | phosphoric acid (orthophosphoric acid) | 2-60 |
| | DL-malic acid | 0.02-5 |
| | sodium dihydrogen phosphate dihydrate | 0.01-5 |
| | fluorine-based surfactant | 0.01-.015 |
| | special modified ionized water | 37.65-65.45 |
| T rinse | modified sodium tungstate | 5-50 |
| | special modified ionized water | 50-95 |

FIG. 3

| Category | Test method | Quality | PFE-CR | | PZ | |
|---|---|---|---|---|---|---|
| | | | n: 1 | n: 2 | n: 1 | n: 2 |
| Scratch hardness | As in JIS K 5600-5-4 (Paint – General Test Methods – Part 5: Mechanical Properties of Coating Films – Section 4: Scratch Hardness (Pencil Hardness). See 1* | F or higher for baked-on enamel | H | H | H | H |
| Adhesion | As in JIS D 0202 (General Rules of Coating Films for Automobile Parts, 3.14 Cross-Cut Adhesion), with 100 squares and a cut spacing of 2 mm. See 1* | 95 to 100/100 | 100/100 | 100/100 | 100/100 | 100/100 |

1* Test piece: A single powder coat was applied over each coating film treated sheet. Film thickness approximately 70 μm. Curing conditions: held at 170°C for 20 minutes.

FIG. 5

| Film name | n number | 120 hours | | 240 hours | | 480 hours | | 600 hours | | 720 hours | |
|---|---|---|---|---|---|---|---|---|---|---|---|
| | | Rust width | Blister width | Rust width | Blister width | Rust width | Blister width | Rust width | Blister width | Rust width | Blister width |
| PZ | 1 | < 1.0 | < 1.0 | 1.4 | | 1.9 | | 2.5 | | 3.0 | |
| PFE-CR | 1 | < 1.0 | < 1.0 | < 1.0 | < 1.0 | | 1.4 | | 1.9 | | 2.0 |
| | 2 | < 1.0 | < 1.0 | < 1.0 | < 1.0 | 1.2 | | 2.0 | | 2.7 | |
| | 3 | < 1.0 | < 1.0 | 1.2 | | 1.8 | | 2.5 | | 2.6 | |
| | 4 | < 1.0 | < 1.0 | < 1.0 | < 1.0 | 1.6 | | 2.3 | | 2.5 | |
| | 5 | < 1.0 | < 1.0 | < 1.0 | < 1.0 | 1.4 | | 2.5 | | 2.9 | |

FIG. 6

(a) Shape of film formed by this surface treatment method (SEM, x10,000)

(b) Shape of film formed by surface treatment method using zinc phosphate (SEM, × 10,000)

SURFACE TREATMENT METHOD AND COATING METHOD FOR STEEL MATERIAL, AND METHOD FOR PRODUCING MACHINE COMPONENT

CROSS-REFERENCE TO RELATED APPLICATIONS

This application is a U.S. National stage application of International Application No. PCT/JP2012/073363, filed on Sep. 12, 2012. This U.S. National stage application claims priority under 35 U.S.C. §119(a) to Japanese Patent Application No. 2011-234331, filed in Japan on Oct. 25, 2011, the entire contents of which are hereby incorporated herein by reference.

BACKGROUND

Field of the Invention

The present invention relates to a surface treatment method and a coating method for a steel material, and to a method for producing a machine component.

Description of the Related Art

In recent years, the machine components used in hydraulic excavators and other such construction machinery have been subjected to various surface treatments as precoating preparation to improve the adhesion and corrosion resistance of the coating.

For example, there is a surface treatment method for a steel material that involves the use of a treatment liquid containing zinc phosphate and that comprises a degreasing step, a first water washing step, an acid washing step, a second water washing step, a neutralization step, a third water washing step, a surface adjustment step, a fourth water washing step, a chemical conversion coating step, a fifth water washing step, and a hot water washing step.

However, a problem is that the treatment liquid containing the zinc phosphate also contains a large amount of heavy metal ions, which are harmful to the environment. Also, because zinc phosphate itself is a deleterious substance, there is a problem of higher costs required by the need for special equipment to perform this treatment (see Japanese Laid-Open Patent Application 2010-106334 (laid open on May 13, 2010), for example).

Accordingly, treatment liquids whose main component is malic acid, orthophosphoric acid, or the like have been developed as treatment liquids that are more environmentally friendly and safer for workers to use, and these have been used in the surface treatment of some parts.

SUMMARY

However, the following problems were encountered with the above-mentioned conventional surface treatment method for a steel material.

Specifically, with a phosphate coating film that gave a fine crystal structure by using orthophosphoric acid as the main component and adding malic acid or another such organic acid, a problem is that because the crystal structure is finer than with a phosphate coating film having a relatively large crystal structure, such as a conventional zinc phosphate coating film, the unstable phosphate or electrolyte remaining on the crystal surface in the treatment step tended to have an adverse effect on adhesion with the coating and so forth.

It is an object of the present invention to provide a surface treatment method and coating method for a steel material, and a method for producing a machine component, with which corrosion resistance and adhesion at least as good as those when using a treatment liquid containing zinc phosphate can be ensured, while the process can be simplified and the cost reduced.

The surface treatment method for a steel material in accordance with a first exemplary embodiment of the present invention comprises a rustproofing step, a rinsing step, and a cleaning step. The rustproofing step involves using a rustproofing liquid containing orthophosphoric acid and an organic acid to perform a rustproofing treatment on the surface of a steel material. The rinsing step involves using a treatment liquid containing an oxo acid salt of a transition metal to perform a rinsing treatment on the surface of the steel material. The cleaning step involves subjecting the surface of the steel material that has undergone the rinsing step to a cleaning treatment.

The surface treatment method for a steel material in accordance with a second exemplary embodiment of the present invention is the surface treatment method for a steel material according to the first exemplary embodiment of the present invention, further comprising a degreasing step of using a degreasing liquid to remove oil and grease from the surface of the steel material.

The surface treatment method for a steel material in accordance with a third exemplary embodiment of the present invention is the surface treatment method for a steel material according to the second exemplary embodiment of the present invention, further comprising a first water washing step of washing the surface of the steel material that has undergone the degreasing step.

The surface treatment method for a steel material in accordance with a fourth exemplary embodiment of the present invention is the surface treatment method for a steel material according to any of the first to third exemplary embodiments, further comprising a second water washing step of using a treatment liquid containing orthophosphoric acid and an organic acid to wash the surface of the steel material that has undergone the rustproofing step.

The surface treatment method for a steel material in accordance with a fifth exemplary embodiment of the present invention is the surface treatment method for a steel material according to any of the first to fourth exemplary embodiments, further comprising a spray step of spraying water on the surface of the steel material that has undergone the cleaning step.

The surface treatment method for a steel material in accordance with a sixth exemplary embodiment of the present invention is the surface treatment method for a steel material pertaining to any of the first to fifth exemplary embodiments, wherein a treatment liquid containing sodium dihydrogen phosphate dihydrate, a fluorine-based surfactant, and special modified ionized water is used in the rustproofing step and the second water washing step.

The surface treatment method for a steel material in accordance with a seventh exemplary embodiment of the present invention is the surface treatment method for a steel material pertaining to any of the first to sixth exemplary embodiments, wherein a treatment liquid containing an oxo acid salt of a transition metal and special modified ionized water is used in the rinsing step.

The surface treatment method for a steel material in accordance with an eighth exemplary embodiment of the present invention is the surface treatment method for a steel material pertaining to any of the first to seventh exemplary embodiments, wherein the oxo acid salt of a transition metal contained in the treatment liquid used in the rinsing step is either a tungstate, a molybdate, or a zirconate.

The surface treatment method for a steel material in accordance with a ninth exemplary embodiment of the present invention is the surface treatment method for a steel material pertaining to any of the first to eighth exemplary embodiments, wherein rustproofing of the steel material and a phosphate coating treatment are carried out simultaneously in the rustproofing step.

The surface treatment method for a steel material in accordance with a tenth exemplary embodiment of the present invention is the surface treatment method for a steel material pertaining to any of the first to ninth exemplary embodiments, wherein the first water washing step is repeated a plurality of times.

The surface treatment method for a steel material in accordance with an eleventh exemplary embodiment of the present invention is the surface treatment method for a steel material pertaining to any of the first to tenth exemplary embodiments, wherein ultrasonic waves or a spray is used in the second water washing step.

The coating method for a steel material in accordance with a twelfth exemplary embodiments of the present invention involves subjecting a steel material that has been treated by the surface treatment method for a steel material according to any of the first to eleventh exemplary embodiments to a coating treatment.

The method for producing a machine component in accordance with a thirteenth exemplary embodiment of the present invention involves producing a machine component by using a steel material that has undergone a coating treatment by the coating method for a steel material pertaining to the twelfth exemplary embodiment.

The method for producing a machine component in accordance with a fourteenth exemplary embodiment of the present invention is the method for producing a machine component pertaining to the thirteenth exemplary embodiment, wherein the machine component is a hydraulic line for a hydraulic excavator.

BRIEF DESCRIPTION OF DRAWINGS

FIG. 2 is a table showing specific examples of the steps of the surface treatment method of FIG. 1;

FIG. 3 is a table of the makeup of the treatment liquids used in the various steps of the surface treatment method of FIG. 1;

FIG. 5 is a table of test results for a scratch hardness test and an adhesion test of steel materials treated by the surface treatment method of an exemplary embodiment of the present invention, as well as comparative example test results;

FIG. 6 is a table of test results for a corrosion resistance test of steel materials treated by the surface treatment method of an exemplary embodiment of the present invention, as well as comparative example test results;

DETAILED DESCRIPTION OF EXEMPLARY EMBODIMENTS

The surface treatment method for a steel material pertaining to an exemplary embodiment of the present invention will now be described through reference to FIGS. 1 to 4.

Overall Configuration of Steel Material Surface Treatment Method

Figure 1:
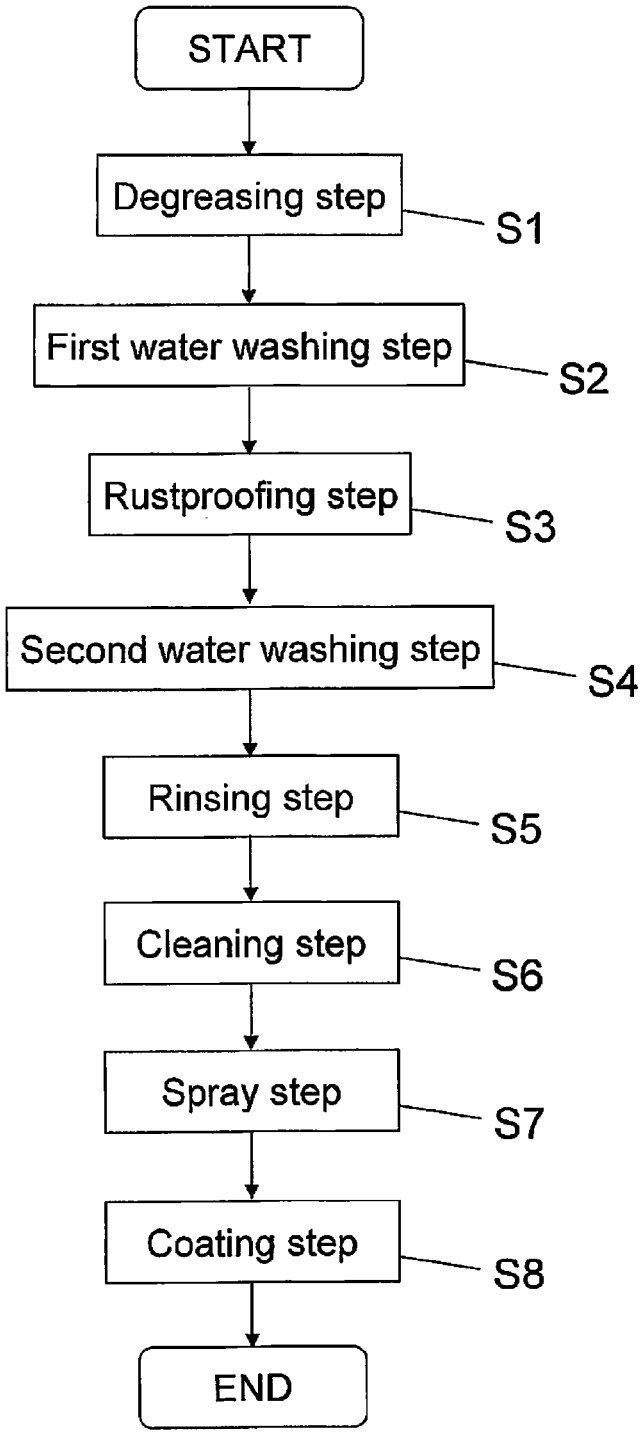
FIG. 1 is a flowchart of the surface treatment method for a steel material pertaining to an exemplary embodiment of the present invention.

The surface treatment method for a steel material pertaining to an exemplary embodiment is, for example, a pretreatment step performed as a coating pretreatment on hydraulic lines 11*a* (FIG. 4) installed on a hydraulic excavator 1. As shown in FIG. 1, a degreasing step (S1), a first water washing step (S2), a rustproofing step (S3), a second water washing step (S4), a rinsing step (S5), a cleaning step (S6), and a spray step (S7) are carried out in that order. After this, a coating step (S8) is carried out.

Figure 4:
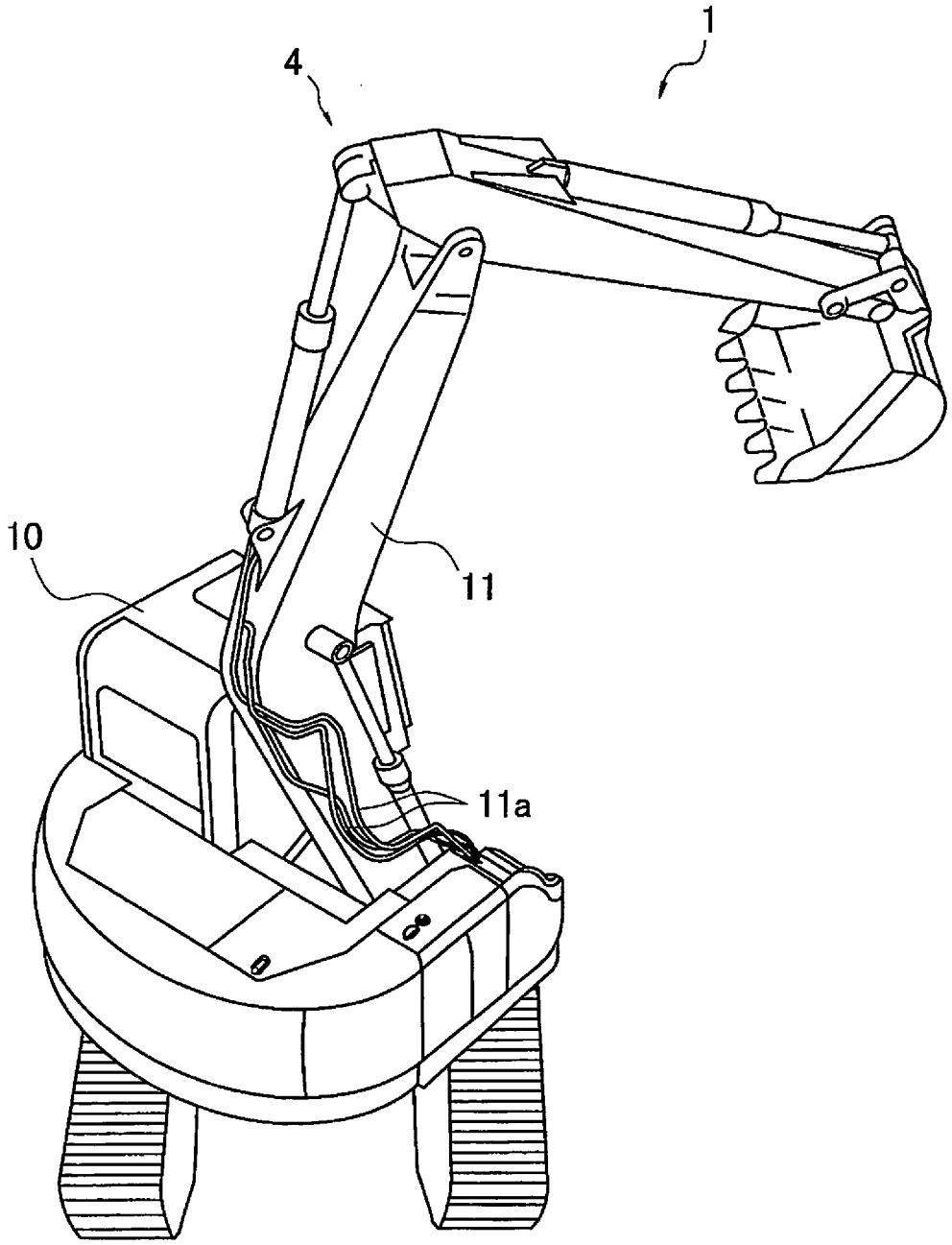
FIG. 4 is an overall oblique view of the configuration of a hydraulic excavator equipped with hydraulic lines treated by the surface treatment method of FIG. 1.

Here, as shown in FIG. 4, for example, the steel material treated by the surface treatment method for a steel material of this exemplary embodiment is the hydraulic lines 11*a*, etc., provided on the cab 10 side of a boom 11 of a work implement 4 installed on the hydraulic excavator 1.

In the degreasing step (S1), as shown in FIG. 2, the material is dipped or sprayed with a 40 to 70° C. degreasing liquid. When environmental impact is taken into account, it is preferable to use degreasing liquid #5000 (made by Nippon Kazai) diluted 5 to 10 times.

The #5000 degreasing liquid can be a treatment liquid containing the components shown in FIG. 3.

- sodium silicate (water glass): 20 to 50 wt % (CAS Registry Number: 1344-09-8 (American Chemical Society))
- diphosphoric acid (pyrophosphoric acid): 0.02 to 2.00 wt % (CAS Registry Number: 2466-09-3 (American Chemical Society))
- special modified ionized water: 50 to 70 wt % (CAS Registry Number: 7732-18-5 (American Chemical Society))

As shown in FIG. 2, in the first water washing step (S2), the steel material treated in the degreasing step (S1) is dipped for 1 to 2 minutes in fresh water (well water).

As shown in FIG. 2, in the rustproofing step (S3), for the purpose of obtaining a fine crystal structure, the steel material treated in the first water washing step (S2) is dipped in a treatment liquid whose main component is orthophosphoric acid and to which an organic acid has been added, or is sprayed with this treatment liquid, thereby simultaneously removing rust from the steel material surface and forming a phosphate coating film.

The treatment liquid can be, for example, Appre Hybrid™ (made by Nippon Kazai) that has been diluted 5 to 10 times.

A treatment liquid containing the components shown in FIG. 3 can be used as the Appre Hybrid liquid.

- phosphoric acid (orthophosphoric acid): 2.0 to 60.0 wt % (CAS Registry Number: 7664-38-2 (American Chemical Society))
- DL-malic acid: 0.02 to 5 wt % (CAS Registry Number: 617-48-1 (American Chemical Society))
- sodium dihydrogen phosphate dihydrate: 0.01 to 5 wt % (CAS Registry Number: 13472-35-0 (American Chemical Society))
- fluorine-based surfactant: 0.01 to 0.15 wt % (CAS Registry Number: 68391-08-2 (American Chemical Society))

This liquid is an aqueous solution, and the water that is used can be fresh water with an electrical conductivity of 20

μS or less, special modified ionized water (CAS Registry Number: 7732-18-5 (American Chemical Society)), or the like.

In addition to the above-mentioned malic acid (DL-malic acid), the organic acid contained in the Appre Hybrid solution can be tartaric acid, citric acid, oxalic acid, or the like.

In the course of research and development of the present invention, it was found that oxalic acid can also be used as the organic acid. When the surface treatment is performed using malic acid, tartaric acid, or citric acid, it is known that an extremely fine crystal structure is obtained. When oxalic acid is used, on the other hand, the crystals become larger, but a crystal structure that has a uniform crystal shape and is finer than that of a conventional zinc phosphate coating film can be obtained. Accordingly, it was confirmed that the same performance will be obtained as that of a fine crystal structure obtained by surface treatment with malic acid or the like. It was similarly confirmed that using this process improves corrosion resistance and adhesion.

The proportion in which the organic acid is used is 0.02 to 5.00 wt %, and more preferably 0.1 to 0.5 wt %.

The higher the proportion in which the organic acid is added, the better the rustproofing performance. Rustproofing performance will decrease if the proportion is less than 0.02 wt %, and if 5.0 wt % is exceeded, the cost increases and is therefore undesirable from an economic standpoint.

Using a treatment liquid containing an organic acid, such as the Appre Hybrid solution, for forming a microstructure coating film on the surface of the steel material as in this exemplary embodiment, locally forms a metal complex and promotes the elution of the metal, and it is believed that phosphate ions react with this eluted metal complex to form a fine crystal structure.

Also, the fluorine-based surfactant contained in the above-mentioned Appre Hybrid solution is one in which the hydrogen atoms in an alkyl chain have been substituted with fluorine atoms, and is characterized by being physicochemically stable and having lower surface tension than a surfactant containing no fluorine atoms. Also, if a nonionic surfactant is used, it is believed that the structure of its hydrophilic portion will form a microstructure coating film on the metal surface, and a better rustproofing effective is exhibited. Thus, in this exemplary embodiment, adding a fluorine-based nonionic surfactant to the Appre Hybrid solution promotes permeability and forms a microstructure coating film on the steel surface.

There are no particular restrictions on the fluorine-based nonionic surfactant, but one or more types of compounds are selected from the group consisting of perfluoroalkyl ethylene oxide adducts, and oligomers containing fluorine groups, hydrophilic groups, and lipophilic groups (such as perfluoroalkyl sulfonic acid compounds and perfluoroalkyl oxide adducts).

The fluorine-based nonionic surfactant is preferably contained in a ratio of 0.01 to 0.15 wt %, and more preferably in the range of 0.01 to 0.1 wt %. This is because there will tend to be no effect if the blend ratio is less than 0.01 wt %, and the cost is higher if the ratio is 0.15 wt % or more, which is uneconomical.

The sodium dihydrogenphosphate dihydrate contained in the Appre Hybrid solution functions as a powerful auxiliary for forming the ultrafine structure coating film on the surface of the steel material. Adding this is expected to further improve rustproofing performance, the effect as a coating primer film, the anchoring effect, conductivity characteristics, and so forth.

The proportion in which the sodium dihydrogenphosphate dihydrate is added is 0.01 to 5.00 wt %, and preferably 0.02 to 0.50 wt %.

In the second water washing step (S4), as shown in FIG. 2, a 100-times dilution of the Appre Hybrid solution used in the rustproofing step (S3) is used to subject the steel material treated in the rustproofing step (S3) to a water washing treatment by spraying or with ultrasonic waves.

This enhances the effect in removing unstable iron phosphate or the like left on the coating film surface of the steel material.

When the water washing treatment is performed ultrasonically, the treatment can be carried out, for example, such that that a vibrator for generating ultrasonic waves of 28 kHz (not shown) is moved three times back and forth in the lengthwise direction of the hydraulic lines 11*a*.

When the water washing treatment is performed by spraying, the treatment liquid is preferably sprayed at a pressure of 0.1 MPa or more.

In this exemplary embodiment, for example, it is possible to use ultrasonic waves when a dipping treatment is performed with a tank system, and to use a spray treatment in other cases. As to the specific products to be treated, pipe-shaped steel materials, such as the hydraulic lines 11*a* (FIG. 4), may be subjected to ultrasonic treatment, while flat or rod-shaped steel materials may be subjected to spray treatment. This allows surface treatment to be carried out reliably regardless of the shape of the steel material.

In the rinsing step (S5), as shown in FIG. 2, the steel material treated in the second water washing step (S4) is dipped for 1 to 2 minutes in a room-temperature T rinsing liquid (made by Nippon Kazai).

A treatment liquid containing the components shown in FIG. 3 can be used as the T rinsing solution used here.

modified sodium tungstate (transition metal oxo acid salt): 5 to 50 wt % (CAS Registry Number: 10213-10-2 (American Chemical Society))

special modified ionized water: 50 to 95 wt % (CAS Registry Number: 7732-18-5 (American Chemical Society))

In the cleaning step (S6), as shown in FIG. 2, the steel material treated in the rinsing step (S5) is dipped for 3 minutes in 40 to 70° C. fresh water (well water).

In this cleaning step, 40 to 70° C. fresh water is used to promote the evaporation of the moisture from the steel surface, but the exemplary embodiments of the present invention are not limited to this, and room-temperature water may be used instead, for example.

In the spraying step (S7), as shown in FIG. 2, the steel material treated in the cleaning step (S6) is sprayed for about 30 seconds with pure water.

To enhance the effect of flushing away the electrolyte or the like left on the surface of the steel material, it is preferable to use fresh water of 20 μS (and more preferably, 10 μS or less). The electrolyte or the like left on the steel surface may also be flushed way by dipping the steel material in this fresh water, rather than by spraying.

With the surface treatment method for a steel material in this embodiment, the surface treatment of an uncoated steel material is performed by the above steps, which allows a microstructure coating film to be formed on the steel material surface while entailing fewer steps than in the past. Therefore, this surface is coated, the coating will work its way into the microstructure, which improves adhesion through an anchoring effect with the steel.

Also, with the surface treatment method for a steel material in this exemplary embodiment, a microstructure coating film that contains a dense crystalline structure can be formed on the steel surface according to the characteristics of the various treatment liquids, so foreign matter such as crystalline water tends not to accumulate inside the crystals, and excellent thermal properties (heat cycle, etc.) can also be obtained.

As a result, coating adhesion and corrosion resistance can be ensured that are equal to or better than those of products that were treated before coating by a conventional surface treatment method using a treatment liquid containing zinc phosphate.

In the coating step (S8), as shown in FIG. 2, coating is performed on the surface of the steel material treated by the surface treatment method described above.

The effect of the steel material surface treatment method in this exemplary embodiment related to coating adhesion and corrosion resistance will be discussed in the working examples given below.

WORKING EXAMPLE 1

The corrosion resistance and the adhesion of a coating applied to the surface of the steel material treated by the steel surface treatment method described in the above exemplary embodiment was examined, the results of which are described through reference to FIGS. 5 to 7.

The "PFE-CR" displayed in the test results shown in FIGS. 5 and 6 indicates the test results for a test piece that had been surface treated by the surface treatment method of an exemplary embodiment of the present invention, using SPCC-SD sheet steel (JIS G3141 sheet steel (100×70×0.8 mm)). More precisely, PFE-CR is a test piece obtained by first performing surface treatment using the Appre Hybrid solution as described in the above exemplary embodiment, or the like, and then applying a single powder coat (Everclad 8010 Natural, made by Kansai Paint).

Meanwhile, "PZ" (zinc phosphate coating film) indicates the test results for a test piece that had been surface treated with a conventional treatment liquid containing zinc phosphate, using the same sheet steel as that used for the PFE-CR test piece (SPCC-SD sheet steel (JIS G3141 sheet steel (100×70×0.8 mm))). More precisely, PZ is a test piece obtained by first performing treatment with industrial-use zinc phosphate made by Partek, and then applying a single powder coat (Everclad 8010 Natural, made by Kansai Paint), just as with PFE-CR.

Coating Scratch Hardness Test and Adhesion Test

FIG. 5 shows the results of a scratch hardness test and an adhesion test conducted on a steel material that had been treated by the steel surface treatment method of the present invention and then coated.

Scratch Hardness Test

First, a scratch hardness test was conducted according to JIS K 5600-5-4 (Paint—General Test Methods—Part 5: Mechanical Properties of Coating Films—Section 4: Scratch Hardness (Pencil Hardness).

The quality required here is at least a pencil hardness of F, in the case of baked-on enamel.

As a result, it was found that the PFE-CR test piece and the PZ test piece both had scratch hardness equivalent to a pencil hardness H or higher.

That is, in the scratch hardness test, comparable results were obtained with the steel surface treatment method of the present invention and the conventional steel surface treatment method.

Adhesion Test

Next, an adhesion test was carried out as set forth in JIS D 0202 (General Rules of Coating Films for Automobile Parts, 3.14 Cross-Cut Adhesion). The number of squares in the adhesion test was 100, and the cut spacing was 2.0 mm.

The quality required here was a state in which the paint did not separate in 95 to 100 of the 100 squares.

As a result, it was found that the PFE-CR test piece and the PZ test piece were similar in that the paint did not separate in any of the 100 squares.

That is, in the adhesion test, the steel surface treatment method of an exemplary embodiment of the present invention and the conventional steel surface treatment method both gave comparable results.

Corrosion Resistance Test

Then, a corrosion resistance test was conducted on the steel material that had been coated after being treated by the steel surface treatment method of the present invention, for steel, the results of which are shown in FIG. 6.

The test was conducted using the same test pieces that those use for the above-mentioned scratch hardness test and adhesion test.

The corrosion resistance test here was conducted as set forth in JIS K 5600-7-1, in which diagonally intersecting scratches were made 20 mm to the inside of the edges of test pieces using the single blade defined in JIS K 5600-5-6. The resulting test pieces were sprayed with salt water, and the width of rusted portions and the width of blistered portions that occurred on part of the coating were measured after 120, 240, 480, 600, and 720 hours to check for salt water spray corrosion resistance.

Elapsed Time of 120 Hours

With the conventional PZ test pieces, the rust width and blister width after 120 hours had elapsed were both less than 1.0 mm.

With the PFE-CR test pieces of an exemplary embodiment of the present invention, the rust width and blister width after 120 hours had elapsed were both less than 1.0 mm, which was the same as the test results for the conventional PZ test pieces.

Thus, the result of the test at an elapsed time of 120 hours was that the test pieces of the present invention gave test results comparable to those of the conventional test pieces, for all of the test pieces.

Elapsed Time of 240 Hours

With the conventional PZ test pieces, the rust width after 240 hours had elapsed was 1.4 mm.

With the PFE-CR test pieces of an exemplary embodiment of the present invention, of the five test pieces, the rust width and blister width after 240 hours had elapsed were both less than 1.0 mm for test pieces 1, 2, 4, and 5. The rust width after 240 hours was 1.2 mm for test piece 3.

Thus, the result of the test at an elapsed time of 240 hours was that the test pieces of an exemplary embodiment of the present invention gave test results superior to those of the conventional test pieces, for all of the test pieces.

Elapsed Time of 480 Hours

With the conventional PZ test pieces, the rust width after 480 hours had elapsed was 1.9 mm.

With the PFE-CR test pieces of an exemplary embodiment of the present invention, of the five test pieces, the rust width after 480 hours had elapsed was 1.2, 1.8, 1.6, and 1.4 mm for test pieces 2, 3, 4, and 5. The rust width after 480 hours was 1.4 mm for test piece 1.

Thus, the result of the test at an elapsed time of 480 hours was that the test pieces of an exemplary embodiment of the present invention gave test results superior to those of the conventional test pieces, for all of the test pieces.

Elapsed Time of 600 Hours

With the conventional PZ test pieces, the rust width after 600 hours had elapsed was 2.5 mm.

With the PFE-CR test pieces of an exemplary embodiment of the present invention, of the five test pieces, the rust width after 600 hours had elapsed was 2.0, 2.5, 2.3, and 2.5 mm for test pieces 2, 3, 4, and 5. The rust width after 600 hours was 1.9 mm for test piece 1.

Thus, the result of the test at an elapsed time of 600 hours was that the test pieces of an exemplary embodiment of the present invention gave test results superior to those of the conventional test pieces, for all of the test pieces.

Elapsed Time of 720 Hours

With the conventional PZ test pieces, the rust width after 720 hours had elapsed was 3.0 mm.

With the PFE-CR test pieces of an exemplary embodiment of the present invention, of the five test pieces, the rust width after 720 hours had elapsed was 2.7, 2.6, 2.5, and 2.9 mm for test pieces 2, 3, 4, and 5. The rust width after 720 hours was 2.0 mm for test piece 1.

Thus, the result of the test at an elapsed time of 720 hours was that the test pieces of an exemplary embodiment of the present invention gave test results superior to those of the conventional test pieces, for all of the test pieces.

As discussed above, the steel surface treatment method of an exemplary embodiment of the present invention gave results that were comparable to those with a conventional steel surface treatment method in a corrosion resistance test.

Shape of Coating Film

Figure 7A:
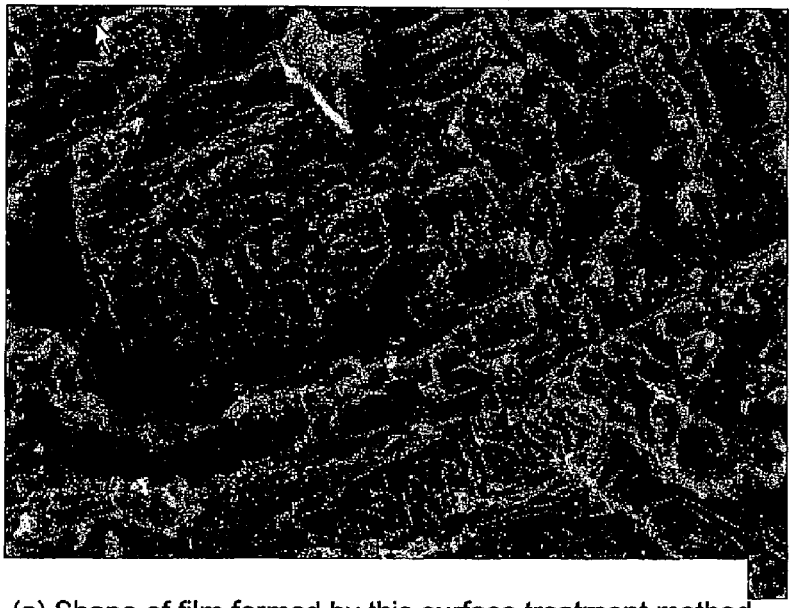
FIG. 7A shows the shape of the coating film formed on the steel material surface by the surface treatment method of an exemplary embodiment of the present invention.

In another exemplary embodiment, the coating film shown in FIG. 7A is formed on the surface of a steel material by using a rustproofing liquid whose main component is the above-mentioned orthophosphoric acid and to which an organic acid has been added. FIG. 7A shows an enlarged image (magnified 10,000 times) captured by SEM (scanning electron microscope).

Figure 7B:
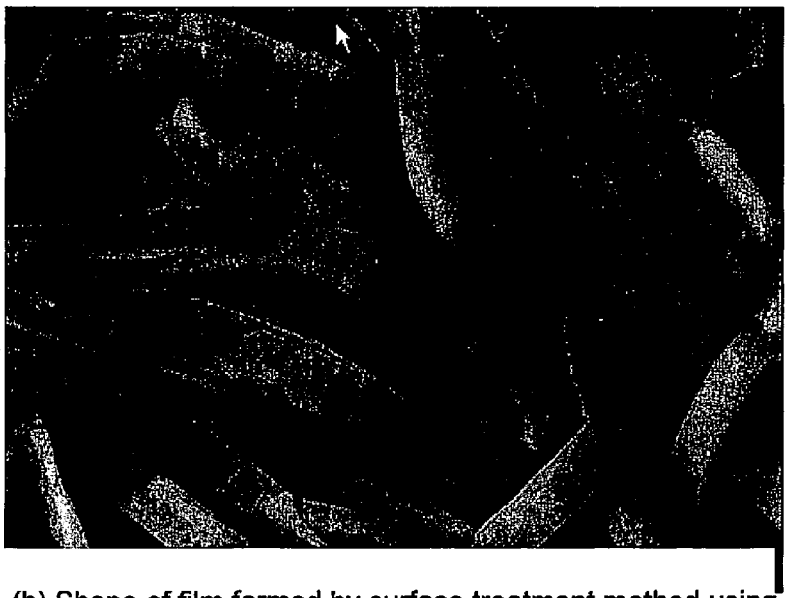
FIG. 7B is a comparative micrograph of the shape of the coating film formed on the steel material surface by a surface treatment method using zinc phosphate.

Meanwhile, FIG. 7B shows an enlarged image (magnified 10,000 times) captured by SEM (scanning electron microscope), of a zinc phosphate treated film formed by a conventional surface treatment method.

A comparison of these reveals that when using a treatment liquid whose main component is orthophosphoric acid and to which an organic acid has been added, there is less height difference between the peaks and valleys of the coating film than with the conventional zinc phosphate treated film, but there are a greater number of portions that are apexes. A comparison of actual surface area shows that a coating film after the surface treatment of an exemplary embodiment of the present invention, in which orthophosphoric acid is the main component and an organic acid has been added, is larger than a conventional zinc phosphate treatment film.

Accordingly, when a rustproofing liquid is used in which orthophosphoric acid is the main component and an organic acid has been added, many fine bumps are formed, and it is surmised that this gives an anchoring effect comparable to that of a conventional zinc phosphate treatment film.

Actually, however, the above-mentioned phosphate treatment film in which orthophosphoric acid was the main component and an organic acid was added gave clearly inferior results in terms of adhesion and corrosion resistance. The reason for this is surmised to be that the performance of a phosphate treatment film having a fine crystal structure is impaired by unstable crystal components or by iron or phosphorus ions remaining on the coating film surface, or that occur on the coating film surface during the course of film formation.

Consideration

The reason why the above-mentioned superior results are obtained with the steel surface treatment method of an exemplary embodiment of the present invention was considered, and as a result the inventors surmised that the effect of the T rinsing liquid used in the surface treatment method of an exemplary embodiment of the present invention is a product of reaction promotion and stabilization of iron ions and phosphorus ions as oxidants.

That is, the inventors came to the conclusion that the T rinsing solution used in an exemplary embodiment of the present invention has the effect of preventing excessive elution of material and stabilizing the fine crystal structure on the surface of the steel material, which results in stabilization and promotion of the anchoring effect of the coating film on the steel material.

Other Exemplary Embodiments

An exemplary embodiment of the present invention was described above, but the present invention is not limited to or by the above exemplary embodiment, and various modifications are possible without departing from the gist of the invention.

In the above exemplary embodiment, an example was given in which a T rinsing solution containing a modified sodium tungstate was used to perform surface treatment of the steel material in the rinsing step shown in FIG. 1. However, the present invention is not limited to this.

For example, a T rinsing solution containing a molybdate, a zirconate, or another such transition metal oxo acid salt may be used instead of s modified tungstate, including the above-mentioned modified sodium tungstate.

In the above exemplary embodiment, an example was given in which a surface treatment method including a degreasing step, a first water washing step, a rustproofing step, a second water washing step, a rinsing step, a cleaning step, and a spray step was performed prior to coating, but the present invention is not limited to this.

For example, the degreasing step is not essential to the present invention if a steel material is used which does not require degreasing, for example.

Similarly, the first water washing step, the second water washing step, and the spray step are not essential to obtaining the effects of the present invention.

In the above exemplary embodiment, an example was given in which the above-mentioned surface treatment method of the present invention was performed as a pretreatment to coating, but the present invention is not limited to this.

For example, the surface treatment method of the present invention can be carried out as a pretreatment for performing a plating treatment or the like.

Here again, a plating treatment with excellent adhesion and so forth can be performed because of the anchoring effect on the steel material surface, just as in a coating treatment.

In the above exemplary embodiment, an example was given in which the first water washing step was performed one time, but the present invention is not limited to this.

For example, the first water washing step may be repeated a plurality of times.

In the above exemplary embodiment, an example was given in which an aqueous solution whose main component was tap water or other such fresh water was used as the Appre Hybrid solution for forming a microstructure coating film on the steel surface, but the present invention is not limited to this.

For example, an Appre Hybrid solution made with distilled water or the like may be used.

However, in this case, it is preferable in terms of corrosion resistance to use water with an electrical conductivity of 20 μS or less.

In the above exemplary embodiment, an example was given in which the steel material treated with the steel surface treatment method of the present invention was the hydraulic lines 11*a* used in the hydraulic excavator 1, but the present invention is not limited to this.

For example, the invention may be applied to the coating (manufacture) of other machine components used in hydraulic excavators and other such construction machinery, or of machine components that undergo a coating treatment and are used in various kinds of vehicles and the like.

In this case, for example, whether to use ultrasonic waves or a spray as the treatment in the second water washing step may be determined according to the shape of the machine component, etc.

INDUSTRIAL APPLICABILITY

The effect of the surface treatment method for a steel material of an exemplary embodiment of the present invention is that corrosion resistance and adhesion at least as good as those with a conventional steel surface treatment method involving the use of a zinc phosphate treatment liquid can be ensured, while the process can be simplified and the cost reduced. This means that the method of an exemplary embodiment of the present invention can be widely applied in the surface treatment of uncoated steel materials.

The invention claimed is:

1. A surface treatment method for a steel material, comprising:

a rustproofing step of using a rustproofing liquid containing orthophosphoric acid and an organic acid to perform a rustproofing treatment on a surface of a steel material;

a rinsing step of using a treatment liquid containing an oxo acid salt of a transition metal to perform a rinsing treatment on the surface of the steel material; and a cleaning step of subjecting the surface of the steel material that has undergone the rinsing step to a cleaning treatment, the treatment liquid used in the rinsing step consisting of an oxo acid salt of a transition metal and water having an electrical conductivity of 20 μS or less.

2. The surface treatment method for a steel material according to claim 1, further comprising a degreasing step of using a degreasing liquid to remove oil and grease from the surface of the steel material.

3. The surface treatment method for a steel material according to claim 2, further comprising a first water washing step of washing the surface of the steel material that has undergone the degreasing step.

4. The surface treatment method for a steel material according to claim 3, wherein the first water washing step is repeated a plurality of times.

5. The surface treatment method for a steel material according to claim 1, further comprising a second water washing step of using a treatment liquid containing orthophosphoric acid and an organic acid to wash the surface of the steel material that has undergone the rustproofing step.

6. The surface treatment method for a steel material according to claim 5, wherein the treatment liquids used in the rustproofing step and the second water washing step contain sodium dihydrogen phosphate dihydrate, a fluorine-based surfactant, and water having an electrical conductivity of 20 μS or less.

7. The surface treatment method for a steel material according to claim 5, wherein ultrasonic waves or a spray is used in the second water washing step.

8. The surface treatment method for a steel material according to claim 1, further comprising a spray step of spraying water on the surface of the steel material that has undergone the cleaning step.

9. The surface treatment method for a steel material according to claim 1, wherein the oxo acid salt of a transition metal contained in the treatment liquid used in the rinsing step is either a tungstate, a molybdate, or a zirconate.

10. The surface treatment method for a steel material according to claim 1, wherein rustproofing of the steel material and a phosphate coating treatment are carried out simultaneously in the rustproofing step.

11. The surface treatment method for a steel material according to claim 1, further comprising a coating step of subjecting the steel material to a coating treatment.

12. The surface treatment method for a steel material according to claim 11, further comprising producing a machine component with the steel material following the coating step.

13. The surface treatment method for steel material according to claim 12, wherein the machine component is a hydraulic line for a hydraulic excavator.

* * * * *